US006338222B1

(12) United States Patent
Hetman, Jr. et al.

(10) Patent No.: US 6,338,222 B1
(45) Date of Patent: Jan. 15, 2002

(54) UNIVERSAL SASH TETHER CLASP AND ANCHORING APPARATUS FOR WINDOW COUNTERBALANCING SYSTEM

(75) Inventors: Frank W. Hetman, Jr., Chanhassen; John E. Bower, Robbinsdale, both of MN (US)

(73) Assignee: Mon-Ray, Inc.

( * ) Notice: Subject to any disclaimer, the term of this patent is extended or adjusted under 35 U.S.C. 154(b) by 0 days.

(21) Appl. No.: 09/430,287

(22) Filed: Oct. 29, 1999

(51) Int. Cl.[7] ..... E05F 1/00
(52) U.S. Cl. ..... 49/445; 16/205
(58) Field of Search ..... 49/445, 446, 98, 49/99, 150, 151; 16/193, 194, 196, 198, 202, 205, 206

(56) References Cited

U.S. PATENT DOCUMENTS

| | | | | |
|---|---|---|---|---|
| 21,136 A | | 8/1858 | Johnson | |
| 452,297 A | * | 5/1891 | Whipple | 16/198 |
| 513,823 A | | 1/1894 | Parrish | |
| 631,529 A | | 8/1899 | McSherry | |
| 740,517 A | | 10/1903 | Bimel | |
| 869,512 A | | 10/1907 | Ocumpaugh | |
| 1,043,045 A | | 10/1912 | Edwards | |
| 1,699,267 A | * | 1/1929 | Appleby | 16/198 |
| 1,897,010 A | | 2/1933 | Pollock et al. | |
| 2,042,372 A | | 5/1936 | Watson | |
| 2,295,689 A | | 9/1942 | Renton | |
| 3,146,825 A | | 9/1964 | Briggs, Jr. et al. | |
| 3,220,064 A | | 11/1965 | Nobes | |
| 3,447,264 A | * | 6/1969 | Foster | 49/150 |
| 3,609,796 A | * | 10/1971 | Skolnik | 49/446 X |
| 3,992,751 A | | 11/1976 | Foster et al. | |
| 4,245,436 A | | 1/1981 | Riegelman et al. | |
| 5,119,592 A | | 6/1992 | Westfall et al. | |

FOREIGN PATENT DOCUMENTS

| | | | | |
|---|---|---|---|---|
| IT | 632993 | * | 2/1962 | 49/446 |

* cited by examiner

*Primary Examiner*—Jerry Redman
(74) *Attorney, Agent, or Firm*—Schroeder & Siegfried, P.A.

(57) ABSTRACT

A window sash tether clasp and anchoring system which is externally mountable for universal use in connection with new or pre-existing conventional double-hung windows, wherein the sash tether clasp is externally mounted on the lower sash of such window and includes an outwardly extending catch having a pair of transversely spaced opposed legs which are designed to engage in the outer diverging walls of a bell shaped anchor that is attached to the end of the balance cord leading from the window balancing system. The externally mountable tether clasp further includes an outwardly extending spring lock which includes an arcuate portion, the extrados surface of which faces the catch and extends within the lower bell mouth of the anchor, thereby holding the anchor in releasable engagement with the catch of the tether clasp.

28 Claims, 3 Drawing Sheets

UNIVERSAL SASH TETHER CLASP AND ANCHORING APPARATUS FOR WINDOW COUNTERBALANCING SYSTEM

BACKGROUND OF THE INVENTION

The present invention is related generally to the art of counterbalancing systems for conventional double-hung or vertical sliding windows and the like, and more specifically to sash tethering devices which are externally mountable for universal use in connection with such counterbalancing systems.

In conventional indoor double-hung or vertical sliding windows systems, use of counterbalancing systems to ease the load of lifting the lower window sash is commonplace. Such counterbalancing systems are most commonly designed to be mounted within the window jambs such that they are substantially, if not completely, hidden from view. For this reason, conventional double-hung windows and the counterbalancing systems there for are generally custom designed and not universally interchangeable with other window brands.

While indoor double-hung windows are most commonly custom built for use with a particular counterbalancing system, outer storm windows of the double-hung type have conventionally been devoid of counterbalancing systems altogether. The reason for this is that outer storm windows are generally of light construction, not requiring any need to offset the load of the lower sash window. However, in recent times, storm windows have been built of a much more solid and heavier construction to help cut down outdoor noise levels. While conventional storm windows are generally constructed with windowpanes of 3/32 inch thickness (SSB) or 1/8 inch thickness (DSB), newer storm windows are oftentimes constructed with 3/16 inch thickness windowpanes, or with 1/4 inch laminated glass. This is particularly the case in homes near airports and the like, where noise levels are significantly increased. Storm windows used in such areas are now commonly constructed with increased strength and insulative capacity, and consequently with increased weight.

As storm windows of this type are not commonly designed to be fitted with counterbalancing systems, particularly with those that are built into the window jambs and hidden from view, there is a distinct need for a counterbalance system which can be mounted to the exterior of such a window for universal application to any type or brand thereof. Such a universal system may be used to modify or repair existing double-hung windows, as well as be incorporated into new windows. It is with this object in mind that we have developed our improved counterbalance sash tether clasp and anchoring system as described and shown hereinafter.

BRIEF SUMMARY OF THE INVENTION

In accordance with the present invention, we have conceived of an improved universally mountable sash tether clasp and anchoring device which provides for convenient accessibility and versatility in the installation and use of new or pre-existing double-hung windows. The sash tether clasp is externally mounted to the lower sash of the window, and includes an improved means for engaging the sash tethering device of the counterbalance system in readily releasable locking engagement.

The tether clasp includes a base portion which is externally mountable upon the lower window sash, and a generally U-shaped catch member and separate locking member which extend outwardly therefrom. The catch member is cantilevered at one end to the base portion and terminates at its other end in a pair of transversely spaced opposed leg members, which are defined by an open channel extending therebetween.

The locking member is disposed below the catch member and is spaced slightly therefrom. The locking member is also cantilevered at one end to the base portion and is free at its opposite end. The intermediate portion of the locking member is curved such that the extrados surface of the arcuate portion faces upwardly toward the catch member. The transverse dimensions of the locking member are less than that of the catch member, and the locking member is generally centrally disposed relative to the catch member, such that the arcuate portion thereof extends upwardly toward the channel extending between the opposite legs of the catch member.

The tethering device which connects to the tether clasp includes a typical balance cord which terminates at its free end with a generally bell-shaped anchor member. The anchor member has outer walls which diverge outwardly from its upper end toward the lower bell mouth portion thereof. The anchor member is constructed such that at least the lower bell mouth portion of the anchor member is hollow, so as to form an inwardly protruding recess in the lower end thereof.

In operation, the generally bell-shaped anchor member of the tethering device may be connected in releasable locking relation with the tether clasp by inserting the anchor member between the catch member and locking member of the tether clasp. The diverging outer wall portions of the anchor member 21 are constructed such that they may be received within the channel portion between the opposing legs of the catch member. Upon insertion of the anchor member in such manner, the lower bell mouth portion of the anchor will engage the arcuate portion of the locking member and cause the same to deflect slightly downward to allow the anchor member to move past the arc and seat against the catch member.

Once the anchor member is seated between the opposing legs of the catch member, the spring bias of the locking member will cause the same to return to its natural resting place, wherein at least the extrados surface of the arcuate portion of the locking member will extend within the lower recess portion of the bell mouth of the anchor member. By so doing, the locking member effectively holds the anchor member of the tethering device in releasable locking engagement with the catch member of the tether clasp, which is connected to the lower sash of the window. Because the counterbalance system exerts an upward biasing force on the tethering device, the outer diverging wall portions of the anchor member engage the opposing legs of the catch member, thereby effectively reducing the load of the lower window sash when opening the same.

Through the use of our universal tether clasp and anchoring system for double-hung windows, an external counterbalancing system may be used to provide versatility with respect to both installation and use on new or pre-existing windows. The improved accessibility and readily releasable locking engagement of the tether clasp and anchor system effectively enhances the performance and ease of operation of the double-hung window upon which it is installed.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
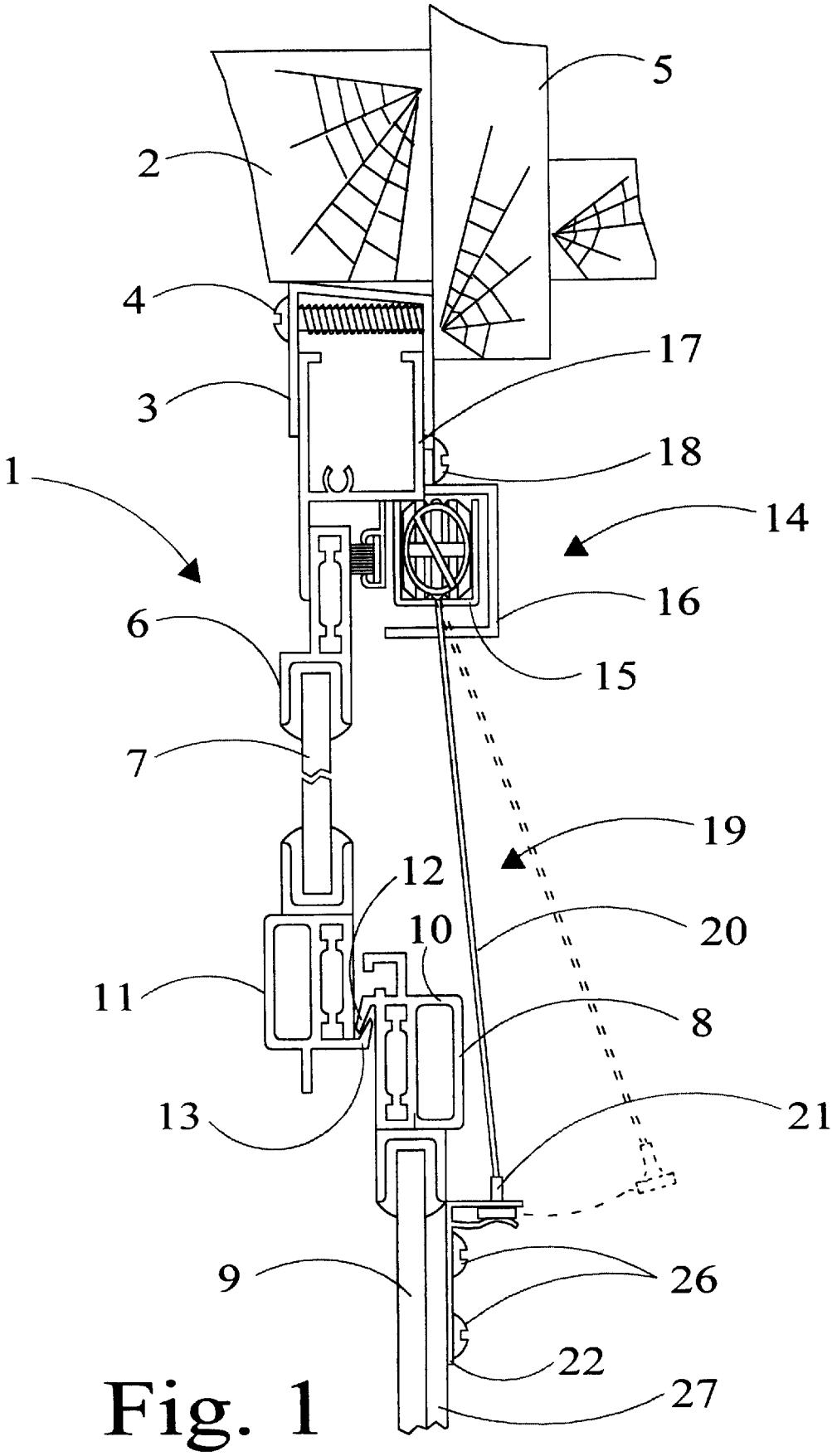
FIG. 1 is a vertical cross-sectional view of a double-hung storm window seated within a window opening and incorporating our invention, the cross-section lines of the window frame having been omitted to facilitate clarity of the drawing and discussion of same.

For purposes of illustration, shown in FIG. 1 of the attached drawings is a conventional double-hung storm window 1 to which our invention has been applied. Storm window 1 is disposed between the overhead window molding 2 and the lower window sill (not shown) in a conventional manner. The outer frame 3 of storm window 1 is appropriately secured within the window opening by conventional means, such as screw 4 which secures frame 3 to the window head 5.

Storm window 1 includes an upper sash 6 carrying an upper window pane 7, and a lower sash 8 carrying a lower window pane 9. As shown in FIG. 1, when sash 8 is lowered into its closed position, its upper frame section 10 preferably interengages with the lower frame section 11 of upper sash 6. In such position, flange 12 of upper frame section 10 and flange 13 of lower frame section 11 interlock to form a tight joint between the upper and lower sashes of storm window 1.

As further shown in FIG. 1, a conventional counterbalancing system 14 including balance mechanism 15 is externally mounted to window 1 adjacent the upper end thereof. Balance mechanism 15 is carried within housing 16 which is secured to the upper frame 17 of the storm window's upper sash 6 by a plurality of conventional screws 18. Extending from the balance mechanism 15 to the lower sash 8 of window 1 is a sash tethering device 19 which is spring biased upwardly by balance mechanism 15.

Tethering device 19 is comprised of a balance cord 20 which terminates at its lower end with an anchor member 21. Tethering device 19 is movable between a releasable locking position wherein anchor member 21 engages tether clasp 22 mounted externally on lower sash 8, and a free position (shown in phantom) wherein anchor member 21 is free from engagement with tether clasp 22.

Figure 2:
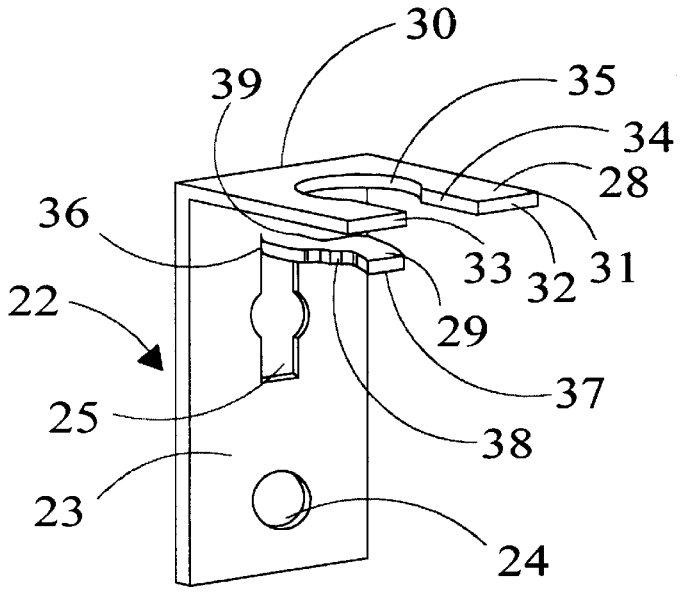
FIG. 2 is a perspective view of a sash tether clasp embodying the principles of our invention which mounts to the lower sash of a double-hung window.
Figure 6:
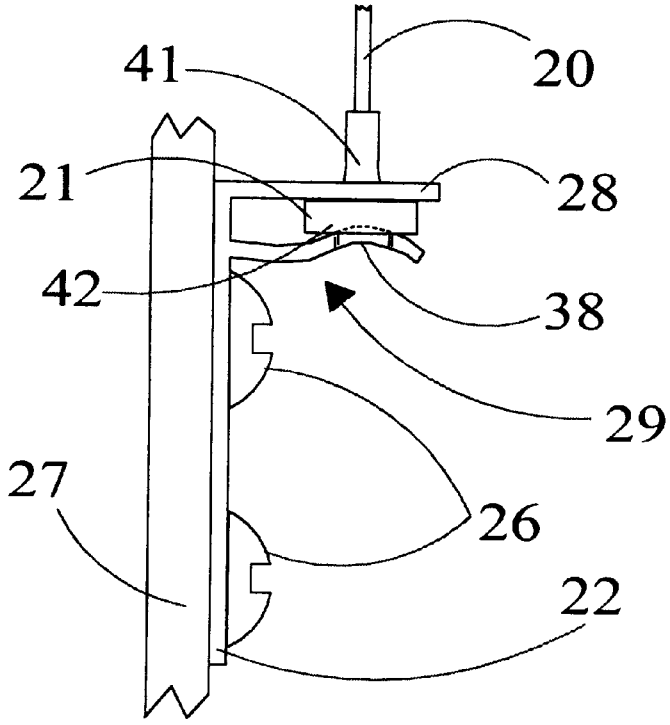
FIG. 6 is a partial side elevational view of the anchor member in FIG. 5 shown in releasable locking engagement with the sash tether clasp shown in FIGS. 2–4, in accordance with our invention.

As shown best in FIG. 2, tether clasp 22 includes a base portion 23 which includes openings 24 and 25 through which conventional screws 26 are inserted to externally mount the same to the outer frame 27 of lower sash 8. Clasp 22 includes a catch member 28 and a locking member 29 which extend outwardly from base portion 23 in a plane generally perpendicular thereto. Catch member 28 and locking member 29 are vertically spaced from one another, whereby the locking member 29 is disposed below catch member 28 and extends outwardly from base portion 23 in a plane generally parallel with catch member 28. Catch member 28 and locking member 29 function to retain anchor member 21 in releasable locking interengagement therebetween, as shown in FIGS. 1 and 6, and described in more detail hereafter.

Figure 4:
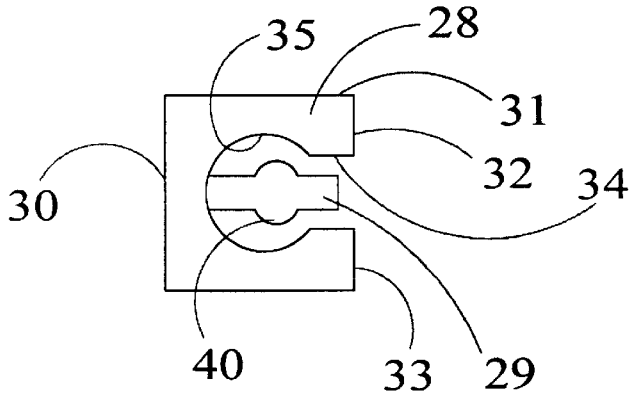
FIG. 4 is a top plan view of the sash tether clasp shown in FIG. 2.

As shown best in FIGS. 2 and 4, catch member 28 is cantilevered at one end 30 to base portion 23, the opposite end 31 of which terminates in a pair of transversely spaced opposed leg members 32 and 33. Disposed between leg members 32 and 33 and forming the same is a cutaway channel portion 34 which leads into the centerly disposed substantially circular cutout portion 35 in catch member 28. Legs 32 and 33, and cutaway portions 34 and 35 give catch member 28 a generally U-shaped configuration which opens outwardly away from the base portion 23 thereof.

Figure 3:
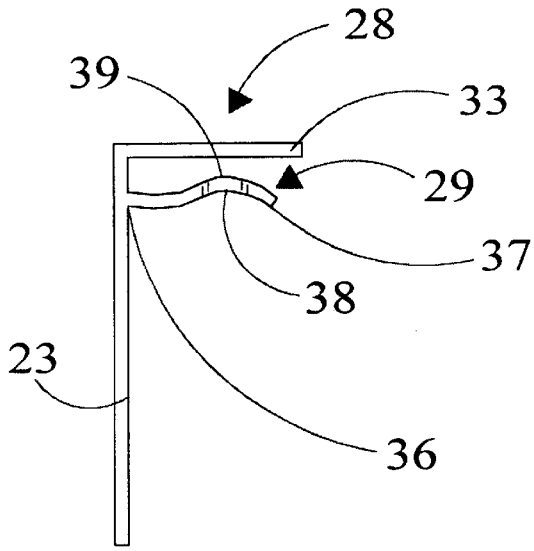
FIG. 3 is a side elevational view of the sash tether clasp shown in FIG. 2.

As best shown in FIGS. 2 and 3, locking member 29 is cantilevered from base portion 23 at one end 36, the other end 37 of which is free. Locking member 29 is preferably formed by cutting or stamping out opening 25 in base portion 23, the upper portion of which remains uncut to allow locking member 29 to be bent outwardly therefrom. Locking member 29 is also formed with the generally arcuate portion 38 having an extrados surface 39 which faces upwardly in the direction of catch member 28. As best shown in FIGS. 2 and 4, locking member 29 is centrally disposed relative to catch member 28, with arcuate portion 38 of locking member 29 extending upwardly toward cutout portions 34 and 35 in catch member 28. Notably, locking member 29 includes a bulbous intermediate portion 40 which forms a part of the arcuate portion 38 which curves upwardly towards catch member 28.

Figure 5:
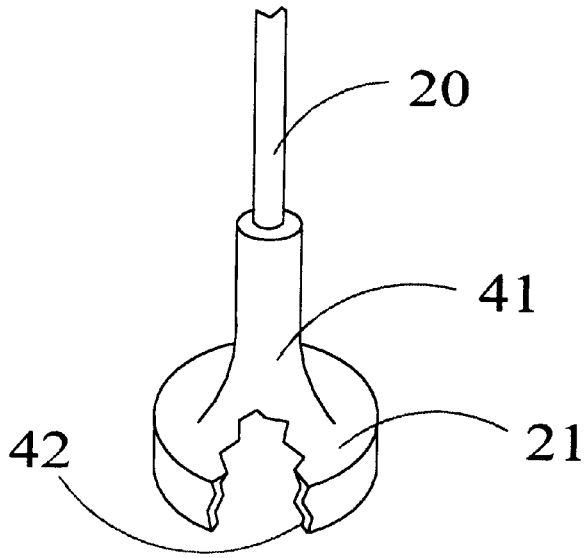
FIG. 5 is a partial perspective view of the terminal end of a balance tethering device showing the anchor member which embodies the principles of our invention, the lower portion of the anchor member being broken away to show the hollow interior thereof.

The operation of tether clasp 22 can best be described with reference to FIGS. 5 and 6. As shown therein, anchor member 21 of the tethering device 19 is generally bell shaped. The outer wall portions 41 of anchor member 21 diverge radially outward from its upper end towards the anchor bell mouth 42 at its lower end. As shown best in FIG. 5, anchor member 21 has a hollow interior, thereby forming an inward recess at its lower bell mouth 42. In order to secure anchor member 21 to tether clasp 22, anchor member 21 is inserted between catch member 28 and locking member 29 through channel 34 so as to be seated within cutaway portion 35 of catch member 28, as shown in FIG. 6.

When anchor member 21 engages tether clasp 22 and is positioned in its releasable locking position, as shown in FIGS. 1 and 6, the upward biasing balance force exerted on anchor member 21 by the balance mechanism 15 through balance cord 20 causes the diverging wall portions 41 of anchor member 21 to engage legs 32 and 33 of catch member 28 adjacent the central cutaway portion 35 thereof. By so doing, the upward balancing force generated by balance mechanism 15 is transferred through anchor member 21 into tether clasp 22 and lower sash 8 of the double-hung window 1, thereby lessening the manual force required to lift sash 8 to an open position.

Upon engaging anchor member 21 with tether clasp 22, anchor member 21 must move past the arcuate portion 38 of locking member 29. By pushing locking member 21 through channel 34 of catch member 28, the lower bell mouth portion 42 of anchor member 21 will engage the extrados surface 39 of locking member 29. This causes locking member 29 to deflect slightly downward such that the peripheral portions of the lower bell mouth end 42 of anchor member 21 can move past the arcuate portion 38 and snap into releasable locking engagement with catch member 28.

Once the anchor member 21 is seated within the central cutaway portion 35 of catch member 28, the spring action of locking member 29 will cause it to return to its resting position as shown in FIG. 6, whereby the extrados surface of locking member 29 extends slightly within the recessed lower bell mouth portion 42 of anchor member 21. Preferably, the spring biasing force of locking member 29 will cause the extrados surface of arcuate portion 38 of locking member 29 to engage the inner walls of bell mouth portion 42 of anchor member 21 and hold anchor member 21 in releasable locking engagement with catch member 28. It is contemplated, however, that the arcuate portion 38 of locking member 29 may not engage the inner wall surfaces of the bell mouth portion 42, yet still extend slightly within the bell mouth portion or detent 42 of anchor member 21, to prevent anchor member 21 from substantial lateral movement, thereby continuing to hold anchor member 21 in releasably locked engagement with catch member 28.

When it is desired to release anchor member 21 from tether clasp 22, for purposes of window cleaning, repair, etc., applying an outward force to anchor member 21 will cause locking member 29 to once again deflect slightly downward to allow the lower peripheral portions of anchor member 21 to pass over arcuate portion 38 of locking member 29. Thus, using substantially the same force as for causing locking engagement, anchor member 21 may then be moved through channel 34 in catch member 28 to a free position such as that shown in phantom in FIG. 1.

Through the use of our improved tether clasp and anchoring system for double-hung windows, it is readily apparent that a universal externally mountable counterbalancing system may be installed on new or pre-existing windows, to enhance the performance and ease the operation thereof. The improved accessibility and readily releasable locking engagement of the tether clasp and anchor system provides versatility with respect to both installation and use of such windows.

It will, of course, be understood that various changes may be made in the form, details, arrangement and proportions of the parts without departing from the scope of the invention which comprises the matter shown and described herein and set forth in the appended claims.

What is claimed is:

1. In an externally mounted balancing apparatus for a double-hung window having a lower sash and having a balancing mechanism for applying a balancing force to a sash-tethering device extending between the balance mechanism and the lower sash of the window, and having a mount on the lower sash of the window, the improvement comprising:

(a) the mount including a tether clasp, said clasp having a catch member and a spring biased locking member, and being constructed and arranged for releasable connection to the tethering device of the balance mechanism;

(b) the tethering device including an anchor member constructed and arranged for releasable engagement of said catch member of said tether clasp, said locking member being constructed and arranged to hold said anchor member in releasable engagement with said catch member; and (c) said anchor member and said tether clasp being cooperatively constructed to facilitate engagement and release of said anchor member upon application of a single force of substantially the same magnitude solely to said anchor member.

2. The balancing apparatus defined in claim 1, wherein said anchor member is disposed between said catch member and said locking member.

3. The balancing apparatus defined in claim 1, wherein the spring biasing force of said locking member holds said anchor member in engaging position with said catch member.

4. The balancing apparatus defined in claim 1, wherein said anchor member has outer wall portions which diverge outwardly and downwardly, thereby providing an engagement surface for said catch member.

5. The balancing apparatus defined in claim 4, wherein said catch member is generally U-shaped, with a pair of opposed spaced legs extending outwardly from said lower sash, said anchor member being constructed and arranged to seat between said opposed legs with said outer wall portions thereof engaging said opposed legs.

6. The balancing apparatus defined in claim 1, wherein said anchor member includes recess-defining wall portions defining a recess into which said locking member extends, said locking member bearing against said recess defining wall portions to hold said anchor member in releasable engagement with said catch member.

7. The balancing apparatus defined in claim 1, wherein said anchor member is generally bell-shaped with diverging wall portions extending to a downwardly opening bell mouth.

8. The balancing apparatus defined in claim 7, wherein said anchor member is moveable between a free position and a releasable locking position disposed between said catch member and said spring biased locking member.

9. The balancing apparatus defined in claim 8, wherein said locking member extends within said bell mouth of said anchor member, thereby holding said diverging wall portions of said anchor member in releasably locked relation relative to said catch member.

10. The balancing apparatus defined in claim 1, wherein said catch member and said locking member extend outwardly from said lower sash in vertically spaced relation to one another.

11. The structure defined in claim 10, wherein said catch member is generally U-shaped in configuration.

12. The balancing apparatus defined in claim 10, wherein said locking member is comprised of a curved tongue member, the extrados surface of which faces said catch member.

13. The structure defined in claim 12, wherein the minor spacial distance between said catch member and said locking member is less than the major vertical dimension of said anchor member.

14. The structure defined in claim 1, wherein said catch member includes a pair of transversely spaced leg members, said anchor member being constructed and arranged to seat between said legs and bear there against as a result of an upward balancing force exerted by said balance mechanism on said anchor member.

15. In an externally mounted balancing apparatus for a double-hung window having a lower sash and having a balancing mechanism for applying a balancing force to a sash-tethering device extending between the balance mechanism and the lower sash of the window, and having a mount on the lower sash of the window, the improvement comprising:

(a) the mount including a tether clasp, said clasp having a catch member and a spring biased locking member, and being constructed and arranged for releasable connection to the tethering device of the balance mechanism;

(b) the tethering device including an anchor member constructed and arranged for releasable engagement of said catch member of said tether clasp, said locking member being constructed and arranged to hold said anchor member in releasable engagement with said catch member;

(c) said anchor member being generally bell-shaped with diverging wall portions extending to a downwardly opening bell mouth, wherein said anchor member is moveable between a free position and a releasable locking position disposed between said catch member and said spring biased locking member; and (d) said locking member being comprised of an arcuate tongue member which is disposed in spaced relation to said catch member, said arcuate tongue member having extrados surface portions extending within said bell mouth of said anchor member when said anchor member is disposed in said releasable locking position.

16. The balancing apparatus defined in claim 15, wherein portions of the extrados surface of said arcuate tongue member bear against said diverging wall portions of said anchor member, thereby holding said anchor member in releasable engagement with said catch member.

17. In an externally mounted balancing apparatus for a double-hung window having a lower sash and having a balancing mechanism for applying a balancing force to a sash tethering device which extends between the balance mechanism and the lower sash of the window, and having a mount on the lower sash of the window, the improvement comprising:

(a) the mount including a tether clasp having a base member, a catch member, and a locking member extending outwardly from said base member in spaced relation to one another, said locking member having a generally arcuate configuration, the extrados surface of which faces said catch member; and (b) the tethering device including an anchor member constructed and arranged for releasable locking engagement of said tether clasp, said anchor member being movable between a free position and a locking position disposed between said catch member and said locking member, and including a locking detent within which said locking member extends when disposed in said locking position.

18. The balancing apparatus defined in claim 17, wherein said catch member and said locking member have opposite ends, one of said ends of each being cantilevered to said base member, and the other of said ends of each being free.

19. The balancing apparatus of claim 17, wherein said catch member has opposite ends, one end of which is cantilevered to said base member, and the other end of which is free, said free end of said catch member being comprised of a pair of opposed spaced legs between which said anchor member seats when disposed in said locking position.

20. The balancing apparatus of claim 19, wherein said locking member is disposed intermediate said opposed legs of said catch member.

21. The balancing apparatus of claim 19, wherein said locking member extends outwardly from said base member in a plane generally parallel to and vertically spaced from said catch member, said locking member being disposed intermediate said opposed legs of said catch member.

22. The balancing apparatus defined in claim 19, wherein said anchor member is generally bell-shaped with downwardly diverging wall portions terminating at a bell mouth end portion, said bell mouth end portion constituting said locking detent and said anchor member being insertable between said catch member and said locking member such that said locking member extends into said bell mouth and holds said anchor member in releasable engagement with said catch member.

23. The balancing apparatus of claim 22, wherein said opposed legs of said catch member engage said diverging wall portions of said anchor member to retain said tethering device.

24. The balancing apparatus of claim 17, wherein said anchor member has diverging wall portions extending toward said locking detent, said diverging wall portions engaging said catch member when said anchor member is disposed in said locking position.

25. The balancing apparatus of claim 24, wherein said catch member includes a pair of opposed spaced legs between which said anchor member is seated and against which said diverging wall portions of said anchor member bear when said anchor member is disposed in said locking position.

26. The balancing apparatus of claim 25, wherein said anchor member is bell-shaped and includes a bell mouth which constitutes said locking detent.

27. A balancing apparatus for applying a balancing force to the lower sash of a double-hung window, comprising:

(a) a balancing mechanism constructed and arranged to be externally mounted to the window;

(b) a tether clasp having a base member constructed and arranged to be externally mounted on the lower sash of the window, said clasp having a catch member and a locking member extending outwardly from said base member in spaced relation to one another;

(c) a tethering device connected to said balancing mechanism and extending to said tether clasp for applying a sash balancing force thereto, said tethering device including an anchor member constructed and arranged for releasable locking engagement with said tether clasp, said anchor member being movable between a free position and a locking position disposed between said catch member and said locking member, and including a locking detent within which said locking member extends when disposed in said locking position;

(d) said anchor member having diverging wall portions extending toward said locking detent;

(e) said catch member including a pair of opposed spaced legs between which said anchor member seats and against which said diverging wall portions of said anchor member bear when disposed in said locking position; and (f) said locking member having a generally arcuately shaped portion, the extrados surface of which faces said catch member and extends within said locking detent of said anchor member when said anchor member is disposed in said locking position, thereby holding said anchor member in releasably restrained engagement with said catch member.

28. The balancing apparatus of claim 27, wherein said anchor member is substantially bell-shaped with a lower bell mouth portion, said bell mouth portion constituting said locking detent of said anchor member.

* * * * *